US007696928B2

(12) United States Patent
Rowell

(10) Patent No.: US 7,696,928 B2
(45) Date of Patent: Apr. 13, 2010

(54) SYSTEMS AND METHODS FOR USING PARASITIC ELEMENTS FOR CONTROLLING ANTENNA RESONANCES

(75) Inventor: Corbett Rowell, Mongkok (CN)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 971 days.

(21) Appl. No.: 11/350,412

(22) Filed: Feb. 8, 2006

(65) Prior Publication Data

US 2007/0182638 A1 Aug. 9, 2007

(51) Int. Cl.
*H01Q 1/38* (2006.01)
*H01Q 21/00* (2006.01)

(52) U.S. Cl. ..... 343/700 MS; 343/814; 343/817; 343/818; 343/815

(58) Field of Classification Search ..... None
See application file for complete search history.

(56) References Cited

U.S. PATENT DOCUMENTS

| | | | | |
|---|---|---|---|---|
| 6,650,294 | B2 * | 11/2003 | Ying et al. | 343/700 MS |
| 7,136,020 | B2 * | 11/2006 | Yamaki | 343/702 |
| 2003/0151557 | A1 * | 8/2003 | Johnson | 343/702 |
| 2004/0032370 | A1 * | 2/2004 | Ito et al. | 343/702 |
| 2005/0024272 | A1 | 2/2005 | Ponce De Leon et al. | |
| 2008/0129639 | A1 * | 6/2008 | Mitsugi | 343/876 |

FOREIGN PATENT DOCUMENTS

| | | | |
|---|---|---|---|
| CN | 1492538 | | 4/2004 |
| EP | 0 523 409 | A1 | 1/1993 |
| EP | 1 231 670 | A2 | 8/2002 |
| EP | 1 469 549 | A1 | 10/2004 |
| GB | 2 364 176 | A | 1/2002 |
| GB | 2 371 924 | A | 8/2002 |
| WO | WO 99/50933 | | 10/1999 |
| WO | WO 01/20718 | A1 | 3/2001 |
| WO | WO 2004/102733 | | 11/2004 |
| WO | WO 2005/029638 | A1 | 3/2005 |
| WO | WO 2005/099039 | A1 | 10/2005 |

OTHER PUBLICATIONS

JP 2001267950 A (Abstract Only), Sep. 28, 2001, Yushin Co. Ltd.
JP 2004172714 (Abstract Only), Nov. 18, 2002, Sony Ericsson Mobile Communications KK.
JP 2005039756 A (Abstract Only), Feb. 10, 2005, Hitachi Kokusai Electric Inc.
CN 1615039 (Abstract Only), Nov. 06, 2003, Benq Corp.
International Search Report issued for PCT/CN2007/000384, dated May 17, 2007.

* cited by examiner

*Primary Examiner*—Trinh V Dinh
(74) *Attorney, Agent, or Firm*—Fulbright & Jaworski L.L.P.

(57) ABSTRACT

Systems and methods for communicating over multiple frequency bands include a driven antenna element and a parasitic element communicatively coupled to the driven antenna element, the parasitic element including at least a first and a second conductive section. The parasitic element can include two or more conductive sections, and the sections can be coupled using a connector (e.g., switching element or trap). Further, some driven antenna elements may be associated with two or more parasitic elements.

31 Claims, 5 Drawing Sheets

SYSTEMS AND METHODS FOR USING PARASITIC ELEMENTS FOR CONTROLLING ANTENNA RESONANCES

TECHNICAL FIELD

The present invention relates in general to multi-frequency antenna systems, and, more particularly, to using parasitic elements for antenna resonance control.

BACKGROUND OF THE INVENTION

Currently, there are a multitude of wireless systems in place, including, inter alia, four varieties of Global System for Mobile Communications (GSM)—GSM 850, 900 GSM, 1800 GSM, 1900 GSM, as well as third generation (3G) systems and emerging fourth generation (4G) systems. BLUETOOTH® and wireless Local Are Network (LAN) capability is also being implemented in mobile phones. Users are demanding more and more functionality, and many wireless engineers are discovering that they need bigger antennas but cannot increase the sizes of handsets.

As a side effect of the popularly recognized Moore's Law for semiconductors, customers and handset suppliers expect consumer technology to keep shrinking in size and increasing in functionality, without regard to the constraints of physics. For many applications, there are fundamental size limitations of antennas that have been reached with today's technology. The antenna, unlike other components inside a handset, sometimes cannot keep decreasing in size. Before the existence of cellular systems, a scientist postulated the physical law responsible for governing antenna size, and the law is now known as "Wheeler's Theorem." In short, Wheeler's Theorem states that for a given resonant frequency and radiation efficiency, the total bandwidth of the system is directly proportional to the size of the antenna. Further, as resonant frequency increases, antenna size usually decreases, and as efficiency increases, antenna size usually increases. Thus, changes to efficiency, bandwidth, or frequency often require changes to antenna size, and changes to frequency, efficiency, or size, often affect bandwidth. This generally represents the physical constraints facing engineers as they design antennas systems for consumer and other devices.

The implications of Wheeler's Theorem for the continued expansion of wireless systems are contrary to consumer expectations regarding bandwidth and size. Currently, antenna sizes required for tri-band GSM are 5.5 cubic centimeters (for internal antennas with a ground plane) and 2.5 cubic centimeters (for antennas without a ground plane directly underneath). The space required by antennas in handsets is currently between 5 to 20% of the total space. Generally, either antennas will become much larger to accommodate additional bandwidth, or antenna performance will decrease to accommodate smaller applications. Using what is known about current systems, it is believed that if required bandwidth doubles and performance stays the same, handset size will accordingly increase by up to 20%.

One method of balancing performance and size is to keep the bandwidth approximately constant while using circuitry to adjust the resonance properties of an active antenna system. Whereas most antennas are passive antennas with up to two connections (feed and ground) to the motherboard/Printed Circuit Board (PCB) and no additional power requirements, an active antenna uses a switching circuit to physically control parts of the antenna.

Engineers use active antenna systems to decrease antenna size while giving the appearance of attaining performance gains. The active antenna system uses a switching element to re-configure the driven antenna elements therein, changing the resonant frequency and maintaining similar efficiency and bandwidth performance for each frequency. Each setting of the antenna acts as a separate antenna for purposes of Wheeler's Theorem; thus, using an active antenna system can seem, in some respects, like receiving several antennas for the physical cost of one. Using this technique, an engineer can design an antenna system that has acceptable performance for multiple wireless networks without an increase in size. Unfortunately, these active antennas are usually very complex and very difficult to design. In addition, most of the active antenna solutions rely on a technology that has yet to be fully commercialized-low power and low-profile Radio Frequency (RF) Micro Electromagnetic (MEM) switches.

FIGS. 1-4 depict various active antenna system designs. FIG. 1 is an illustration of a switched matching circuit active antenna system 100. This system, used, e.g., in the NOKIA® 8810 handset (c. 1998), employs diode 101 to switch additional matching component 102 between antenna element 103 and RF Module 104. This can be suitable for changing the frequency resonance for a single band antenna, but is not suitable for multi-band antennas This is because a matching circuit is usually tuned for a single frequency band, and changing a single matching circuit will usually only shift the resonance by 2-5%, which is generally not enough to switch an entire frequency band for multi-band antenna applications.

FIG. 2 is an illustration of switched feed active antenna system 200. By switching between feed locations 201 and 202, it is possible to shift the resonant frequency properties of antenna element 203. This technique, however, includes on-board, high-power RF switching element 204, and it can be very difficult to avoid intrinsic losses from the RF switching element. Further, it can be difficult to independently control the resonance properties of two or more frequency bands since both resonances are dependent on the feed placement.

FIG. 3 is an illustration of switched ground active antenna system 300. By switching between ground locations 301 and 302, it is possible to shift the resonant frequency properties of antenna element 203. This technique is similar to the switched feed technique of FIG. 2, but it does not require a high-power RF switching element. However, it can be difficult to independently control the resonance properties of two or more frequency bands since both resonances are dependent on the ground placement.

FIG. 4 is an illustration of reconfigurable antenna system 400. First introduced in antenna array systems, reconfigurable antennas can be employed in patch antenna arrays. A reconfigurable patch array is shown as system 400. A set of patch antenna elements 401-404, connected by a series of RF switches 405-407 can be turned "on" or "off," rendering them electrically invisible and effectively reconfiguring the physical geometry of the antenna system as a whole.

Reconfigurable systems, such as system 400, can become quite complex since RF switching components 405-407 often require a DC ground connection. Since such antennas usually cannot tolerate a DC ground at switching element locations, an additional microstrip line can be used to isolate the DC ground from each patch antenna element 401-404. The isolating microstrip line usually only works for a particular frequency; thus a multi-band antenna will usually require multiple isolators or a single, but complex, isolator. In addition, since the surface current on each of patch antenna elements 401-404 passes through a respective switching element 405-407, antenna performance often decreases due to the Ohmic losses in the switching element. One technique to avoid Ohmic losses is to use multiple switches per antenna element; however this increases total system cost and complexity.

In the prior art, there is no active antenna technology available that can provide performance at multiple frequency bands with a minimum of complexity. Consequently, there is no technology currently available that can provide switching for multiple band antennas at a size and a price that is desirable for wireless device consumers.

BRIEF SUMMARY OF THE INVENTION

The present invention is directed to systems and methods, various embodiments of which include a driven antenna element communicatively coupled to one or more parasitic elements, wherein each parasitic element contains one or more switches or other elements used to control the resonant length thereof. At each resonant length of a given parasitic element, the antenna system is operable to resonate at a frequency band in addition to a native frequency or shifted native frequency of driven antenna element.

In one example embodiment, each parasitic element includes two or more conductive sections with each section connected to an adjacent section by a switching element. One of the end sections may be connected to a ground. By closing/opening the switching element(s), sections of the parasitic element can be progressively connected together, and the resonant length of the parasitic element is thereby adjusted. Accordingly, a parasitic element with three sections has three possible resonant lengths and can be used to excite at least three other resonant frequencies in the antenna system.

Additionally or alternatively, some embodiments may include trap connectors between sections of parasitic elements to provide control of the resonant length thereof. Traps allow a parasitic element to avoid switching, while adding two or more resonant frequencies to the main antenna simultaneously.

Because such embodiments affect the resonant lengths of parasitic elements rather than directly affecting driven elements, various embodiments of the present invention can be implemented without the use of high-power RF switches or complex isolating. Such embodiments may be used in consumer devices at a lower cost than the described prior art systems.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
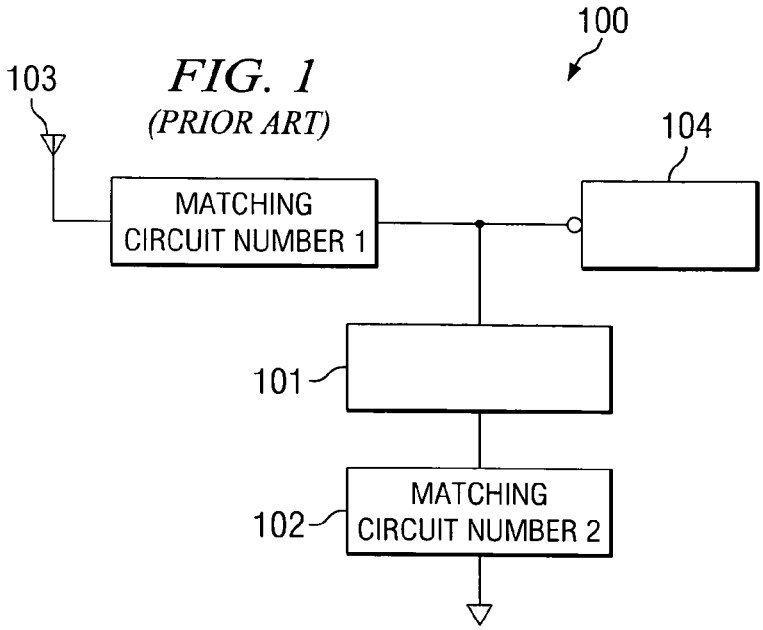
FIG. 1 (PRIOR ART)
FIG. 1 is an illustration of a switched matching circuit active antenna design.
Figure 2:
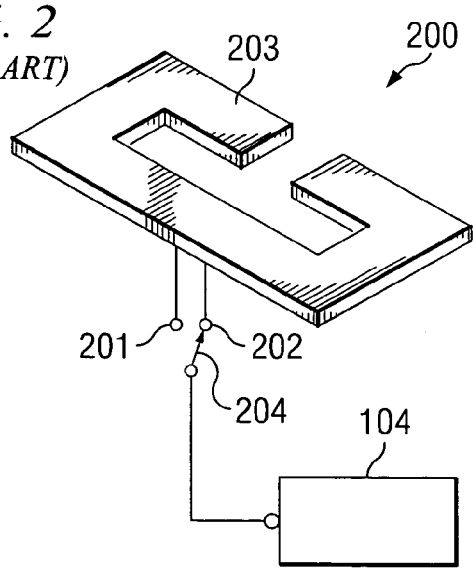
FIG. 2 (PRIOR ART)
FIG. 2 is an illustration of a switched feed active antenna design.
Figure 3:
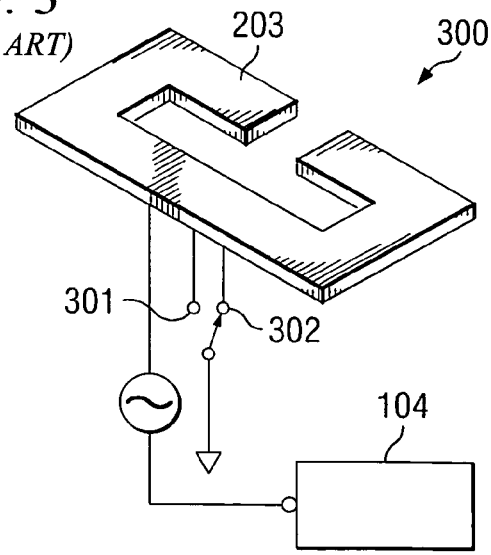
FIG. 3 (PRIOR ART)
FIG. 3 is an illustration of a switched ground active antenna design.
Figure 4:
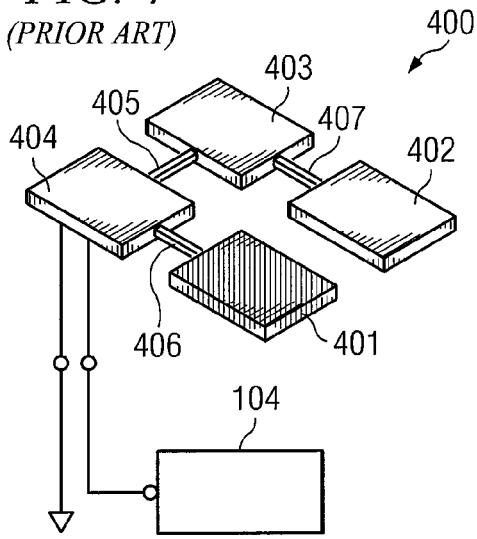
FIG. 4 (PRIOR ART)
FIG. 4 is an illustration of a reconfigurable antenna design.
Figure 5:
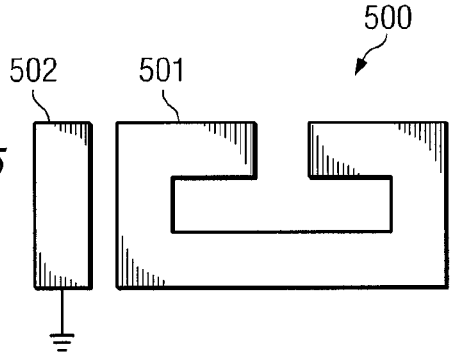
FIG. 5 is an illustration of an exemplary multi-band antenna system, adapted according to at least one embodiment of the invention.

FIG. 5 is an illustration of exemplary multi-band antenna system 500, adapted according to at least one embodiment of the invention. System 500 includes driven antenna element 501 and parasitic element 502. In this example, parasitic element 502 is communicatively coupled to driven antenna element 501, and it is operable to add at least two frequency bands to antenna system 500 other than any bands already provided by driven antenna element 501. Such feature is a result of the structure of parasitic element 502, which, as explained below, includes at least two separate conductive sections.

Parasitic elements, such as element 502, can be generally described as conductors that may be of an arbitrary geometry and placed in the near field of a driven antenna element (e.g., driven antenna element 501). Parasitic elements can also be connected to ground, although a ground connection is not required for all applications. A parasitic element has a native resonance frequency ($f_p$). At frequencies other than $f_p$, the parasitic element is similar to a capacitive load on a driven antenna element, shifting the antenna element's resonant frequencies down by a small amount. At the resonant frequency of the parasitic element, the parasitic element has a much greater effect on a driven antenna element's resonant frequencies and can even excite the additional frequency in the driven antenna element, thereby adding at least one resonant frequency to the antenna system.

In various embodiments of the present invention, parasitic element 502 is operable to excite two or more resonant frequencies in system 500, as explained in more detail below. The additional resonant frequencies may be used to provide a handset or other device (e.g., computer, Personal Digital Assistant (PDA), commercial and/or military antenna arrays, and the like) with additional communication bands, thereby turning an otherwise single-band antenna system into a three-band (or more) antenna system. Further, various example embodiments described below excite the additional frequency bands with little mechanical complexity, thereby offering lower cost and smaller size antenna systems than are available in the prior art.

Figure 6:
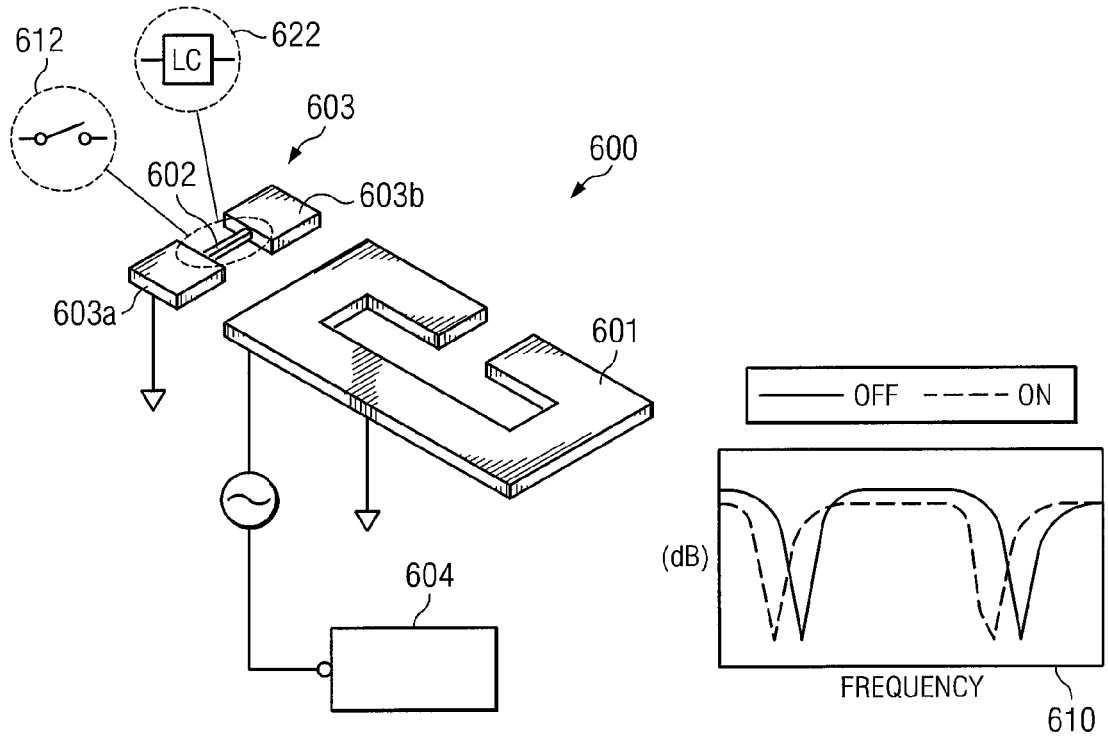
FIG. 6 is an illustration of an exemplary multi-band antenna system, adapted according to at least one embodiment of the invention.

FIG. 6 is an illustration of exemplary multi-band antenna system 600, adapted according to at least one embodiment of the invention. System 600 includes driven antenna element 601 and parasitic element 603. Driven antenna element 601, by itself, can send and/or receive electromagnetic signals over at least one frequency band (i.e., the native frequency band of driven antenna element 603) even without parasitic element 603. The presence of parasitic element 603 excites at least two frequency bands in system 600 and also shifts the native resonant frequency of driven antenna element 601. However, such effects are generally predictable and can be part of the design of system 600.

Parasitic element 603 is communicatively coupled to driven antenna element 601, such that element 603 can excite element 601 at additional frequency bands. The actual positioning of element 603 may depend on various factors including, e.g., shape of elements 601 and 603, desired wavelength, and the like, and in this case, parasitic element 603 is positioned in the near field of driven antenna element 601 in a location that optimizes resonance at desired frequencies.

The operability of parasitic element 603 is provided, in this case, by the unique structure of element 603. Parasitic element 603 includes components 603*a* and 603*b* that are connected using connecting element 602. Connecting element 602, in this example, may be any of a variety of switches, including, e.g., a diode, a MEM, a Field Effect Transistor (FET), or a gallium arsenide (GaAs) switching element operable to open and close a circuit at radio frequencies (for consumer handheld products, the frequency of switching may be approximately 400 MHz to 10 GHz), and example of which is shown as RF switch 612. Connecting element 602 may also be a trap, as explained in more detail below. When connecting element 602 is open, the resonant length of parasitic element 603 is only as long as component 603*a*. The shape, and especially the length, of a parasitic element determines its fp, and such generalization applies to parasitic element 603. The resonant frequency of element 603 when connecting element 602 is open can be referred to as "fp1", and it determines at least one of the resonant frequencies of system 600 attributable to parasitic element 603.

When connecting element 602 is closed, component 603*b* has a continuous path to the ground. Thus, the resonant length of parasitic element 603 includes the combined lengths of components 603*a* and 603*b*. The added length gives parasitic element 603 a different $f_p$ ("$f_{p2}$") than when connecting element 602 is open, and $f_{p2}$ determines at least another of the additional resonant frequencies of system 600 attributable to parasitic element 603. Thus, parasitic element 603 is operable to excite at least two additional frequency bands in driven antenna element 601, thereby allowing system 600 to provide performance in at least three frequency bands, although not necessarily at the same time. Graph 610 shows a generalized frequency response for driven antenna element 601 when connecting element 602 is open and closed (it should be noted that graph 610 omits the one or more bands that are due to the native frequency of driven antenna element 601).

One example of such an antenna system employs an approximately 50 mm-long parasitic element that includes a RF switching element coupling one component that is 10 mm and another component that is 40 mm. The 10 mm component is connected to ground, and the parasitic element is placed one to two millimeters from the patch antenna. Under such conditions, the parasitic element is operable to cause the patch antenna to resonate at 1.2 GHz and 6 GHz in addition to any shifted native frequencies. It should also be noted that the presence of grounded components (e.g., a camera, RF shielding, etc.) nearby may affect the resonant frequencies of both the parasitic element and the patch antenna and that specific implementations account for such effects.

In the example above, element 602 is described as a switching element; however, various embodiments of the invention are not so limited. For instance, switching element 602 may be replaced by a trap in some embodiments. A trap generally refers to a component that has inductive and capacitive (LC) elements therein. A trap with appropriate LC components provides performance at both of the frequency bands in graph 610 simultaneously, and an example of a trap is shown as LC component 622. It should be noted that the native frequency of driven element 601 is also shifted at two different amounts at the same time. One example of a trap embodiment is a parallel Inductor-Capacitor trap with component values of 4.7 nH and 1.0 pF, respectively, placed approximately 10 mm from one end of a 50 mm parasitic element. This configuration would allow two resonances on a single parasitic element. The trap blocks the higher frequencies while allowing the lower frequencies to reach the end of the parasitic element, thereby facilitating two resonances in the parasitic element. Similar to the switch example above, the parasitic element is then placed in the near field of a patch antenna and is operable to cause the patch antenna to resonate at 1.2 GHz and 6 GHz in addition to any shifted native frequencies.

Also in the example above, driven antenna element 601 includes both a ground connection and a connection to RF module 604 (also known as a "feed connection"). Various antenna elements available today include only a feed connection with no ground connection. The properties of an antenna without a ground connection are different than the properties of an antenna with a ground connection, and sometimes, very different. However, the concept of providing a parasitic element, such as element 603, remains the same in both types of systems. Such an arrangement is shown in FIG. 7.

Figure 7:
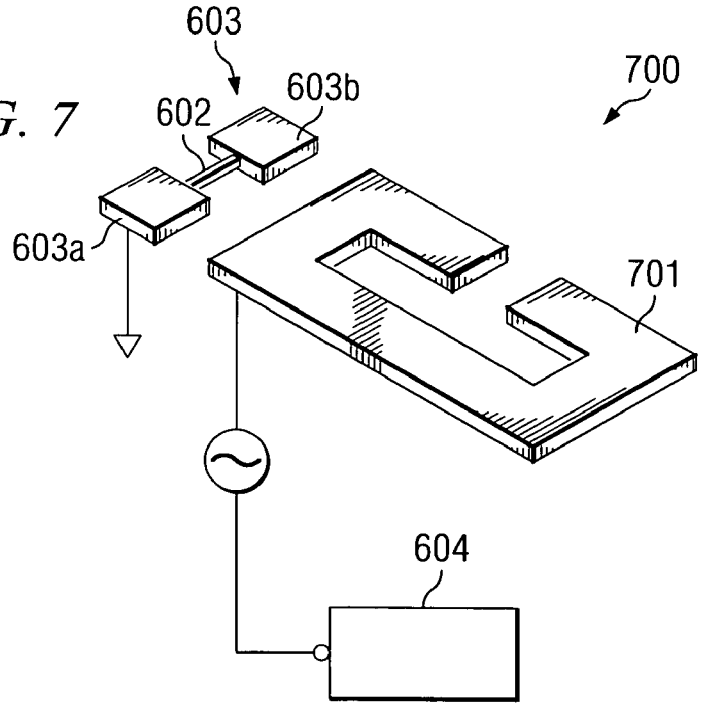
FIG. 7 is an illustration of an exemplary multi-band antenna system, adapted according to at least one embodiment of the invention.

FIG. 7 is an illustration of exemplary multi-band antenna system 700, adapted according to at least one embodiment of the invention. System 700 includes driven antenna element 701, which has no ground connection. System 700 also includes parasitic element 603 with switching element 602, as in FIG. 6, above. While parasitic element 603 with switching element 602 are indicated as being the same as in FIG. 6, it should be noted that the parasitic element used in system 700 may have properties that are the same or different than those of system 600, and, in fact, the properties of driven antenna element 701 may dictate different properties for parasitic element 603.

Just as in system 600 (of FIG. 6), parasitic element 603 is operable to excite at least two frequency bands in system 700, using switching element 602. Further, switching element 602 may be replaced with an appropriate trap, as described above.

The parasitic elements of various embodiments are not limited to having two components connected by a single switching element or trap. In fact, a parasitic element can contain three or more components, as shown in FIGS. 8 and 9.

Figure 8:
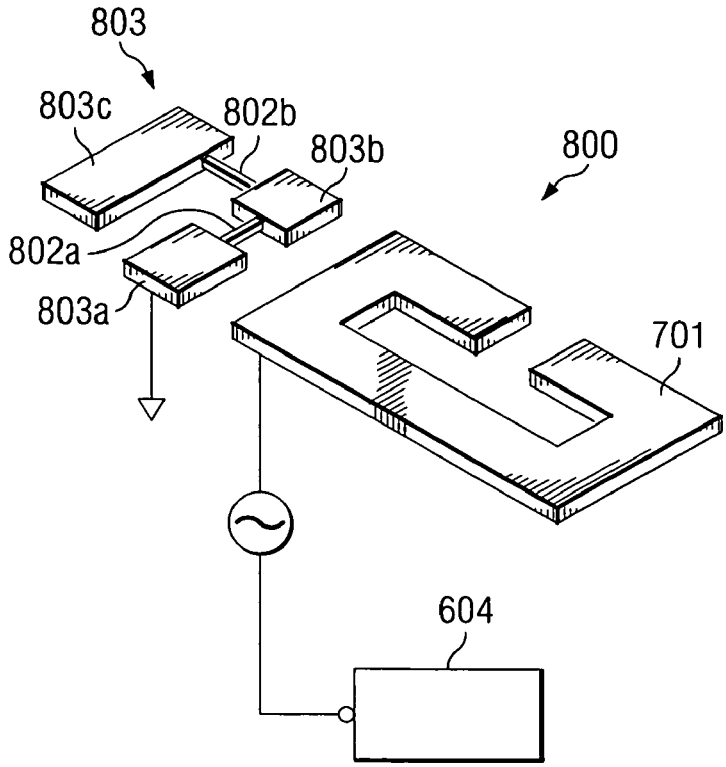
FIG. 8 is an illustration of an exemplary multi-band antenna system, adapted according to at least one embodiment of the invention.

FIG. 8 is an illustration of exemplary multi-band antenna system 800, adapted according to at least one embodiment of the invention. System 800 is similar to system 700 (of FIG. 7), except that parasitic element 803 includes three components, 803*a*-803*c*. Further, parasitic element 803 has two connecting components, 802*a* and 802*b*.

Thus, when switches are used as connectors 802*a* and 802*b*, a user can open switching element 802*a*, making the resonant length of parasitic element 803 the same as that of component 803*a*. By closing switching element 802*a* and opening switching element 802*b*, parasitic element is effectively the size and shape of components 803*a* and 803*b*. Furthermore, by closing both switches 802*a* and 802*b*, parasitic component 803 is effectively the size and shape of components 803*a*-803*c*. Each one of the three arrangements has its own $f_p$, and, therefore, excites a frequency band in system 700. Thus, parasitic element 803 is operable to excite at least three frequency bands in system 700—one for each component 803*a*-803*c*. It should also be noted that connecting components 802*a* and 802*b* may be traps, rather than switches, thereby providing performance for all frequency bands simultaneously and without switching.

Figure 9:
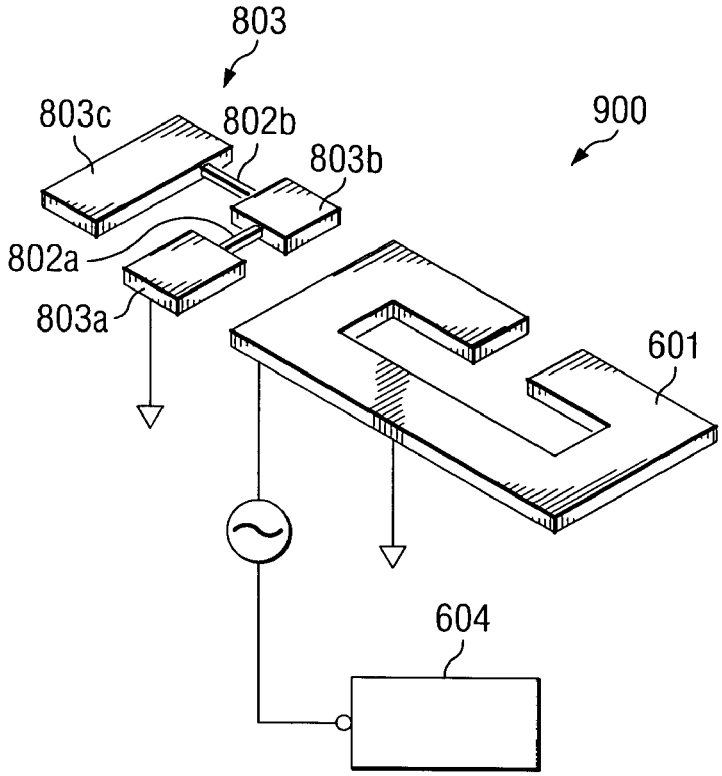
FIG. 9 is an illustration of an exemplary multi-band antenna system, adapted according to at least one embodiment of the invention.

FIG. 9 is an illustration of exemplary multi-band antenna system 900, adapted according to at least one embodiment of the invention. System 900 is similar to system 800 (of FIG. 8), except that driven antenna element 601 includes both a ground connection and a feed connection. System 900 can also be described as being similar to system 600 (of FIG. 6), except that parasitic element 803 includes three components, 803*a*-803*c*, rather than two. In fact, multiple arrangements can be adapted for a variety of applications wherein a main antenna does or does not include a ground connection and wherein the parasitic element includes two or more individual sections (e.g., components 803*a*-803*c*).

Figure 10:
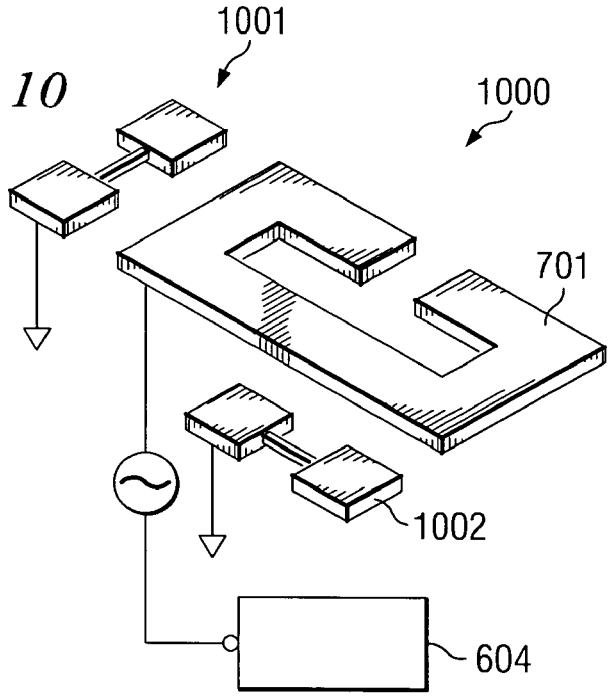
FIG. 10 is an illustration of an exemplary multi-band antenna system, adapted according to at least one embodiment of the invention.

In fact, various embodiments of the invention are not limited to having only one parasitic element, as shown in FIG. 10. FIG. 10 is an illustration of exemplary multi-band antenna system 1000, adapted according to at least one embodiment of the invention. System 1000 is similar to system 700 (of FIG. 7), except that system 1000 has two parasitic elements, 1001 and 1002. Various embodiments may be scaled to include two, three, or more parasitic elements, depending on the specific application. Using the principles described above with regard to FIG. 7, parasitic elements 1001 and 1002 may excite at least four frequency bands in system 1000 in addition to shifting the native frequencies of driven antenna element 701. While driven antenna element 701 is shown without a ground connection, an embodiment similar to system 1000 may be created that includes a driven antenna element with both feed and ground connections. Further, either or both of parasitic elements 1001 and 1002 may each include more than two components, as depicted in FIGS. 8 and 9.

The embodiments shown in FIGS. 5-10 provide advantages over prior art systems. As explained above, a parasite shifts a native frequency of a driven element slightly and additionally excites one or more other, different frequencies. In some designs, the shift may be slight such that both the shifted native frequencies and original native frequencies service the same communications bands, respectively. Thus, by switching sections of parasitic elements on and off, a user can control performances at the added frequencies somewhat independently of the performance at the active antenna's resonant frequencies. However, prior art switched feed, switched ground, and switched matching circuit systems operate by changing a native frequency rather than exciting additional frequencies, such that independent control is not possible.

Further, since parasitic elements are not connected to signal feeds, there is usually no need to use high-power RF switches, as in switched feed circuits and reconfigurable antennas. Still further, various embodiments of the invention do not require the complex DC isolating that was described above with regard to reconfigurable antennas, since the switching is performed on parasitic elements rather than on driven elements. Additionally, whereas the switches in a reconfigurable antenna would generally incur a high radiation loss because of their placement in a driven element, switches in the parasitic elements of various embodiments do not incur such losses. Because of these advantages, various embodiments can use cheaper and simpler switches and keep mechanical complexity and radiation loss to a minimum. This may allow some embodiments to be included in consumer devices sooner and in a larger number of products than for prior art systems.

While the examples in the figures above depict driven antenna elements and parasitic elements in the same plane, it should be noted that various embodiments may place such elements in different planes. Further, parasitic elements and driven antenna elements may be any appropriate size or shape, depending on the application and other design specifications. For example, a main antenna may be a patch antenna, a Planar Inverted F Antenna (PIFA), a bipole antenna, a monopole antenna, or the like. Further, parasitic elements and the sections that make up the parasitic elements may be designed to be any appropriate shape, as long as such parasitic elements are operable to excite at least two frequency bands to an antenna system in addition to shifting any resonant frequencies already provided by a driven antenna element.

Figure 11:
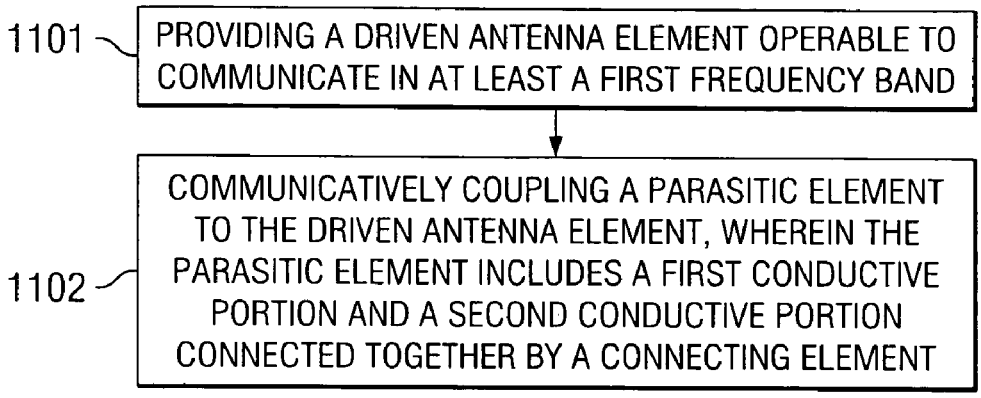
FIG. 11 depicts an exemplary method that may be performed when building an antenna according to one or more embodiments of the invention.

FIG. 11 depicts exemplary method 1100 that may be performed when building an antenna system according to one or more embodiments of the invention. In step 1101, a driven antenna element is provided and is operable to communicate in at least a first frequency band. The driven antenna element can be any kind of antenna capable of resonating in the first frequency band. For instance, the driven antenna element may be a patch antenna operable to communicate at one or more frequencies corresponding to GSM 800/900/1800/1900, 3G (e.g., Universal Mobile Telecommunications System, Code Division Multiple Access 2000), Wideband CDMA, digital TV, BLUETOOTH®, and the like.

In step 1102, a parasitic element is communicatively coupled to the driven antenna element, wherein the parasitic element includes a first portion and a second portion connected together by a connecting element. In this example, the parasitic element is operable to excite at least two frequency bands (e.g., one or more of the bands listed above) in the antenna system in addition to shifting the first frequency band. It should be noted that the shifting may or may not move the first frequency band out of a communications band. Communicatively coupling can include placing the parasitic element in the near field of the driven antenna element, such that it causes the main antenna to resonate at other and different frequency bands. Step 1102 may further include selecting characteristics (e.g., length, shape, material, and the like) of the parasitic element so as to design the antenna system to resonate in one or more established communication bands. It should also be noted that the presence of grounded components (e.g., a camera, RF shielding, etc.) nearby may affect the resonant frequencies of both the parasitic element and the driven antenna element and that steps 1101 and 1102 may include accounting for such effects.

In some embodiments, method 1100 may include adding more parasitic elements and/or adding more portions and connecting elements to parasitic element(s). In other words, the antenna system may be scaled for use in a variety of multi-band applications by placing an appropriate number of parasites and/or parasite portions to add a desired number of resonant frequencies to the antenna system. Further, either or both of steps 1101 and 1102 may include mounting or printing one or more of the elements onto a PCB. Still further, the connecting component may be an RF switching element an LC trap component, or any other connector now known or later developed that may provide a connection between one or more parasite portions.

Figure 12:
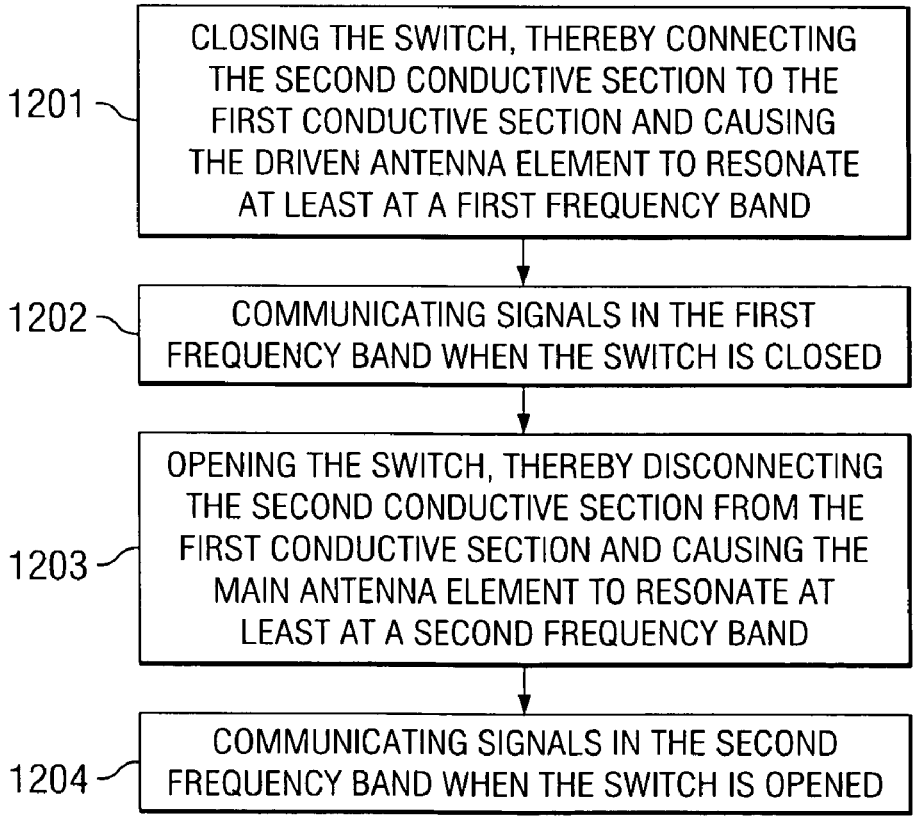
FIG. 12 depicts an exemplary method that may be performed when operating an antenna according to one or more embodiments of the invention.

FIG. 12 depicts exemplary method 1200 that may be performed when operating an antenna according to one or more embodiments of the invention, the antenna including a driven antenna element and a parasitic element communicatively coupled to the driven antenna element, and wherein the parasitic element includes at least a first and a second conductive section coupled together with a switching element. Method 1200 may be performed, for example, by a microprocessor in a telephone handset to switch between different operating bands.

In step 1201, the system closes the switching element, thereby connecting the second conductive section to the first conductive section and causing the driven antenna element to resonate at least at a first frequency band that is different from a shifted native frequency band of the driven antenna element. In step 1202, the system communicates signals in the first frequency band when the switching element is closed. In one example, the driven antenna element is a dual-band antenna element with shifted native frequencies in bands corresponding to GSM900 and GSM1900, and the parasitic element is employed to excite two more bands. When the switching element is closed, the antenna system is operable to communicate in bands corresponding to GSM900, GSM1900, and/or another band, such as a 3G band (the first of the two additional bands due to the parasitic element), in step 1202.

In step 1203, the system opens the switching element, thereby disconnecting the second conductive section from the first conductive section and causing the driven antenna element to resonate at least at a second frequency band that is different from the first frequency band and the shifted native frequency bands. In step 1204, the system communicates signals in the second frequency band when the switching element is opened. Continuing with the example above, when the switching element is opened, the antenna system may be operable to communicate at GSM900, GSM1900, and/or another band, such as GSM1800 (the second of the two added bands due to the parasitic element), in step 1202. Thus, as illustrated in method 1200, an antenna system according to various embodiments of the present invention may provide a number of frequency bands for communication using a parasitic element with two or more sections and one or more switches.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system for communicating over multiple frequency bands, said system comprising:

a driven antenna element; and a parasitic element communicatively coupled to said driven antenna element, said parasitic element including at least a first and a second conductive section, the first and second conductive sections coupled by a connector element, the connector element causing the parasitic element to have a first resonant length at some times and a second resonant length at other times, the first and second resonant lengths being different.

2. The system of claim 1 wherein the connector element comprises a switching element.

3. The system of claim 2 wherein said parasitic element has a connection to a ground.

4. The system of claim 3 wherein said first conductive section includes said connection to said ground such that said second conductive section is connected to said ground by closing said switching element, and such that said second conductive element is disconnected from said ground by opening said switching element.

5. The system of claim 4 wherein said parasitic element is operable to excite a first frequency band in said system and shift a native resonant frequency of said driven antenna element when said switch is closed, and wherein said parasitic element is operable to excite a second frequency band in said system and shift said native resonant frequency of said driven antenna element when said switch is open.

6. The system of claim 1 wherein said first and second conductive sections are coupled through a trap.

7. The system of claim 6 wherein said trap includes an Inductive-Capacitive (LC) element tuned to excite at least two frequency bands to said system simultaneously.

8. The system of claim 1 further comprising an additional parasitic element communicatively coupled to said driven antenna element, said additional parasitic element comprising at least a third and a fourth conductive section.

9. A system for communicating over multiple frequency bands, said system comprising:

a driven antenna element; and a parasitic element communicatively coupled to said driven antenna element, said parasitic element including at least a first and a second conductive section, wherein said first and second conductive sections are coupled together with a switching element, wherein said parasitic element has a connection to a ground, wherein said first conductive section includes said connection to said ground such that said second conductive section is connected to said ground by closing said switching element, and such that said second conductive element is disconnected from said ground by opening said switching element, and wherein said parasitic element comprises a third conductive section and another switching element, said another switching element connecting said second conductive section to said third conductive section when closed.

10. A method for building an antenna component, said method comprising:

providing a driven antenna element, said driven antenna element operable to communicate in at least a first frequency band; and communicatively coupling a parasitic element to said driven antenna element, wherein said parasitic element includes a first conductive portion and a second conductive portion connected together by a connecting element, the connector element causing the parasitic element to have a first resonant length at some times and a second resonant length at other times, the first and second resonant lengths being different.

11. The method of claim 10 wherein said parasitic element is operable to excite at least two frequency bands in said antenna component.

12. The method of claim 10 further comprising disposing at least a portion of said antenna component on a Printed Circuit Board (PCB).

13. The method of claim 10 wherein said connecting element is a Radio Frequency (RF) switching element.

14. The method of claim 13 further comprising:

closing said RF switching element, thereby increasing a resonant length of said parasitic element and causing said antenna component to resonate at a second frequency band different from said first frequency band; and opening said RF switch, thereby decreasing a resonant length of said parasitic element and causing said antenna component to resonate at a third frequency band different from said first frequency band.

15. The method of claim 14 wherein and first conductive portion is connected to a ground, such that said second conductive portion is connected to said ground when said RF switching element is closed.

16. The method of claim 10 wherein said connecting element is a trap.

17. The method of claim 10 wherein said antenna element is a microstrip antenna.

18. The method of claim 10 wherein said antenna element is a Planar Inverted F Antenna (PIFA).

19. The method of claim 10 wherein said parasitic element further includes a third portion connected to said second portion using another connecting element.

20. The method of claim 19 wherein said switching element is selected from the list consisting of:

a Radio Frequency (RF) switch;

a diode; and a gallium arsenide semiconductor component.

21. A method for operating a multi-band antenna system, said multi-band antenna system including a driven antenna element and a parasitic element communicatively coupled to said driven antenna element to form an antenna component, said driven antenna element operable to resonate at a first frequency band, and wherein said parasitic element includes at least a first and a second conducting section coupled together with a switching element, said method comprising:

closing said switching element, thereby connecting said first conducting section to said second conducting section and causing said antenna component to resonate at least at a second frequency band; and opening said switching element, thereby disconnecting said second conducting section from said first conducting section and causing said antenna component to resonate at least at a third frequency band.

22. The method of claim 21 wherein said closing said switching element further includes:

shifting said first frequency band;

and wherein said opening said switching element further includes:

shifting said first frequency band;

and wherein said shifted first frequency band is different from said second and third frequency bands.

23. The method of claim 21 wherein said first conducting section includes a connection to a ground.

24. The method of claim 21 wherein said second frequency band corresponds to Global System for Mobile Communication (GSM) 900, and wherein said third frequency band corresponds to Wideband Code Division Multiple Access (WCDMA).

25. The method of claim 24 further comprising communicating in a fourth frequency band.

26. The method of claim 21 wherein said second frequency band corresponds to Global System for Mobile Communication (GSM) 1800, and wherein said third frequency band corresponds to GSM900 and GSM1900.

27. A system for communicating at multiple frequency bands, said system comprising:

means for communicating signals in a first frequency band;

means positioned within a near field pattern of said communicating means for shifting said first frequency band and for causing said communicating means to resonate in at least two other frequency bands different from said shifted first frequency band, said means for causing including at least a first and a second conducting section; and means for conductively connecting said first and said second conducting sections, the conductively connecting means causing the shifting means to have a first resonant length at some times and a second resonant length at other times, the first and second resonant lengths being different.

28. The system of claim 27 wherein said conductively connecting means includes at least a switching element.

29. The system of claim 27 wherein said conductively connecting means include at least a trap comprising an Inductive Capacitive (IC) circuit operable to cause said communicating means to resonate at said at least two other frequency bands simultaneously.

30. The system of claim 27 wherein said first and second conducting sections are shaped such that said at least two other frequency bands are between 400 MHz and 10 GHz.

31. The system of claim 27 wherein said first conducting section is connected to a ground, such that said conductively connecting means provide a path from said ground to said second conducting section.

* * * * *